US011540629B2

(12) United States Patent
McGregor et al.

(10) Patent No.: US 11,540,629 B2
(45) **Date of Patent: *Jan. 3, 2023**

(54) UNDERMOUNT DRAWER SLIDE POSITION ADJUSTMENT APPARATUS AND METHOD OF USE

(71) Applicant: Hardware Resources, Inc., Bossier City, LA (US)

(72) Inventors: Dennis McGregor, Dallas, TX (US); Greg Davis, Dallas, TX (US)

(73) Assignee: Hardware Resources, Inc., Bossier City, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/304,449

(22) Filed: Jun. 21, 2021

(65) Prior Publication Data

US 2021/0307511 A1 Oct. 7, 2021

Related U.S. Application Data

(63) Continuation of application No. 16/741,191, filed on Jan. 13, 2020, now Pat. No. 11,039,687.

(51) Int. Cl.
*A47B 88/407* (2017.01)
*A47B 88/427* (2017.01)

(52) U.S. Cl.
CPC ..... *A47B 88/407* (2017.01); *A47B 88/427* (2017.01); *A47B 2088/4274* (2017.01); *A47B 2088/4278* (2017.01); *A47B 2210/0054* (2013.01)

(58) Field of Classification Search
CPC ..... A47B 88/407; A47B 88/427; A47B 2088/4274; A47B 2088/4278; A47B 2210/0054
USPC ..... 312/334.4
See application file for complete search history.

(56) References Cited

U.S. PATENT DOCUMENTS

| | | | |
|---|---|---|---|
| 3,196,237 | A | 7/1965 | Westgate, Jr. |
| 3,975,601 | A | 8/1976 | Whelan |
| 4,038,508 | A | 7/1977 | Mapelsden |
| 4,082,925 | A | 4/1978 | Hufford |
| 4,131,771 | A | 12/1978 | Erickson et al. |
| 4,259,856 | A | 4/1981 | Wingert |
| 4,785,190 | A | 11/1988 | Frankena |

(Continued)

*Primary Examiner* — Janet M Wilkens
*Assistant Examiner* — Timothy M Ayres
(74) *Attorney, Agent, or Firm* — Schultz & Associates, P.C.

(57) ABSTRACT

An undermount drawer slide mounting clip releasably attaches a drawer to a drawer rail assembly mounted in a cabinet carcass. The apparatus is capable of effecting positional adjustments of the drawer in three directions without removing the drawer from the cabinet carcass. The apparatus is comprised of a body slidingly engaged with a bonnet. A trigger pivotally connected between the body and the bonnet. A spring loaded catch slidable within the bonnet and acted on by the trigger to releasably attach the apparatus to a drawer rail assembly. A threaded spindle rotates within the base and adjusts the horizontal position of the drawer. A ramp adjustably connected to the base adjusts the vertical position of the drawer by rotation of a threaded barrel. A plunger extends from a housing connected to the body to adjacent the drawer rail assembly and adjusts the depth of the drawer.

16 Claims, 13 Drawing Sheets

(56) References Cited

U.S. PATENT DOCUMENTS

| | | | | |
|---|---|---|---|---|
| 5,589,671 | A | 12/1996 | Hackbarth et al. | |
| 5,719,712 | A | 2/1998 | Ishikawa | |
| 6,374,696 | B1 | 4/2002 | Blake, III et al. | |
| 6,913,334 | B2 | 7/2005 | Weichelt | |
| 7,621,815 | B2 | 11/2009 | Bosserdet, Jr. | |
| 3,024,839 | A1 | 9/2011 | Lewis, II | |
| 8,424,984 | B2 | 4/2013 | Ritter | |
| 8,979,223 | B2 | 3/2015 | Huang | |
| 9,101,213 | B2 | 8/2015 | McGregor et al. | |
| 10,149,539 | B2 | 12/2018 | McGregor et al. | |
| 10,314,396 | B2 | 6/2019 | Hsu et al. | |
| 10,470,570 | B2 | 11/2019 | Chen et al. | |
| 10,631,637 | B2 | 4/2020 | Lucas | |
| 11,039,687 | B1 * | 6/2021 | McGregor ..... | A47B 88/407 |
| 2012/0292465 | A1 | 11/2012 | Holzer et al. | |

* cited by examiner

UNDERMOUNT DRAWER SLIDE POSITION ADJUSTMENT APPARATUS AND METHOD OF USE

CROSS-REFERENCE TO RELATED APPLICATIONS

This application is a continuation of U.S. application Ser. No. 16/741,191, filed Jan. 13, 2020, now U.S. Pat. No. 11,039,687, granted on Jun. 22, 2021. The patent application identified above is incorporated here by reference in its entirety to provide continuity of disclosure.

FIELD OF THE INVENTION

The present invention relates to the field of drawer slides for mounting drawers in cabinetry. More particularly this disclosure relates to an undermount drawer slide mounting clip for releasably coupling a drawer to a drawer slide assembly.

BACKGROUND OF THE INVENTION

Drawer slide assemblies typically include telescoping slides mounted to the interior of the cabinet carcass and the drawer. Drawer slides are typically mounted on the bottom or the sides of the drawer and cooperate to allow the drawer to be opened or closed. Undermount drawer slides have several advantages over side mounted drawer slides. For example, increased weight bearing capacity and drawer width. Another advantage of undermount drawer slides is that they are hidden from normal view when the drawer is open, improving the aesthetic appeal of the drawer and the cabinet.

Proper alignment of the drawer face with the cabinet face is also important to appearance of the drawer and cabinet. Proper adjustment of the drawer face in three directions, "horizontal," "vertical," and "depth."

Unwanted changes in drawer face adjustments over time generally occurs due to use of the drawer. These changes represent a problem in the art because of the resulting poor appearance of the drawer over time. Eliminating such unwanted changes is desirable.

The prior art offers many partial solutions to the necessity of adjusting a drawer face relative to a cabinet carcass. However, none of these solutions provide a way to secure adjustments over time.

For example, U.S. Pat. No. 6,913,334 to Weichelt discloses a device for establishing an adjustable connection between a drawer and a furniture guide rail. The device comprises a base part adapted for connection to the drawer and a detent recess adapted for connection to the guide rail. The tolerance between the drawer and the guide rail may be manually adjusted in two directions. A furniture guide rail includes a suitable detent for engagement with the detent recess. No provision is made to prevent the adjustments from changing during use of the slides.

U.S. Pat. No. 8,424,984 to Ritter discloses an apparatus for releasably coupling a drawer to a drawer pull-out guide. The apparatus comprises a holding part which interacts with a mating part of the guide rail. The holding part is flexible to compensate for longitudinal play of the drawer in relation to the rail. The apparatus allows for depth and horizontal adjustment, but makes no provision for preventing movement of the adjustments while the drawer is in use.

U.S. Publication No. 2012/0292465 to Holzer, et al. discloses a coupling device for a drawer. The device includes a fixing portion mounted to the drawer and a coupling portion for attachment to a guide rail. The device is capable of providing adjustments in a vertical direction and a horizontal direction.

U.S. Pat. No. 9,101,213 to McGregor, et al. discloses a device that provides for adjustment in three directions, horizontal, vertical, and depth. However, the device does not provide mechanisms to retain adjustments over time. The device also does not provide for incremental vertical adjustments.

A simple, cost effective solution for attaching a drawer to a drawer slide assembly that provides directional adjustment with relative permanence is needed. Further, there is also a need for an undermount clip that may be adjusted without use of tools.

SUMMARY OF THE INVENTION

The undermount drawer slide clip disclosed is configured to releasably attach a drawer to a drawer slide assembly mounted in a cabinet carcass. It is capable of adjustment in three directions, without removing the drawer from the cabinet. It is also capable of retaining the adjustments made during repeated use of the drawer.

Accordingly, the drawer slide assembly is comprised of a cabinet rail, an intermediate rail, and a drawer rail. The undermount drawer slide clip comprises a base which includes a partially threaded ramp and a helical knob. The base further includes a threaded spindle which is further connected to a bonnet. The bonnet includes a lever arm, catch and spring. A depth adjuster is attached to the base and includes a housing, a plunger, and a lever.

The cabinet rail is mounted to the cabinet carcass, the intermediate rail is slidingly engaged with the cabinet rail, and the drawer rail is slidingly engaged with the intermediate rail. The body of the undermount drawer slide clip mounting apparatus is mounted to the underside of a drawer. The base is slidingly engaged with the bonnet. The threaded spindle rotates within the base and affects the lateral position of the bonnet relative to the base. The lever arm is pivotally engaged with the bonnet and the catch is spring loaded and slidable within the bonnet. The helical knob rotates and engages the partially threaded ramp to slidably adjust the position of the ramp relative to the base. The lever of the depth adjuster pivots within the housing and engages the plunger which extends from the housing.

In use, the lever arm moves the catch for releasable engagement with the drawer rail of the drawer slide assembly. The drawer rail further engages the threaded ramp. The vertical position of the drawer is affected by adjustment of the position of the ramp relative to the base by rotation of the helical knob. Teeth on the helical knob prevent movement of the ramp after adjustment of the vertical position of the drawer. The lateral position of the drawer is affected by adjustment of the position of the bonnet relative to the base through rotation of the spindle. The depth position of the drawer is affected by adjustment of the position of the plunger relative to the housing through rotation of the lever.

In an alternate embodiment, the bonnet includes a pawl which engages ratchet of the spindle to prevent rotation and secure the position of the spindle after adjustment. In another alternative embodiment, the bonnet includes two pawls that engage a ratchet on the spindle to prevent rotation of the spindle after adjustment.

BRIEF DESCRIPTION OF DRAWINGS

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

DETAILED DESCRIPTION OF THE INVENTION

Figure 1:
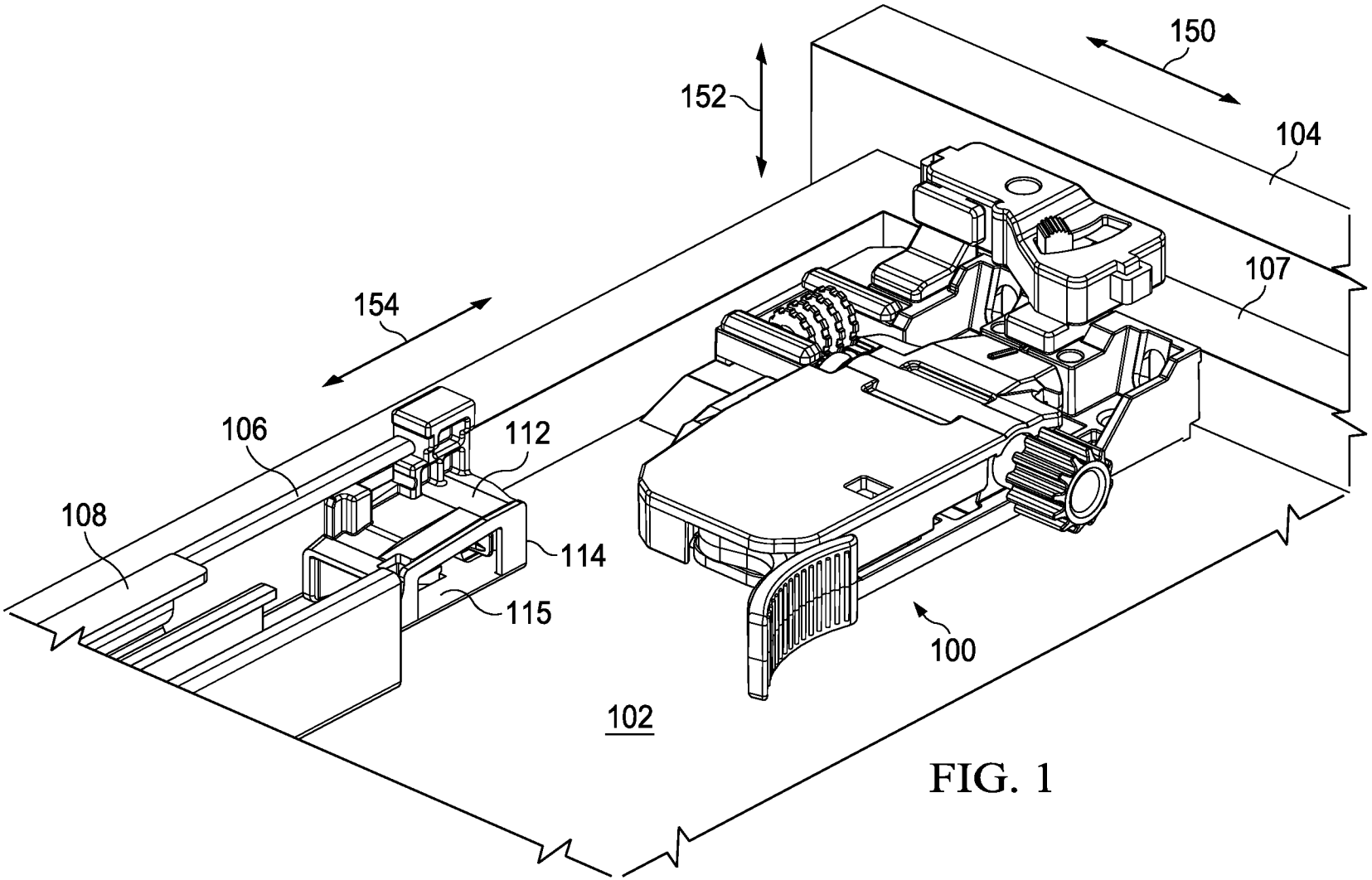
FIG. 1 is an isometric view of a preferred embodiment in use.
Figure 9A:
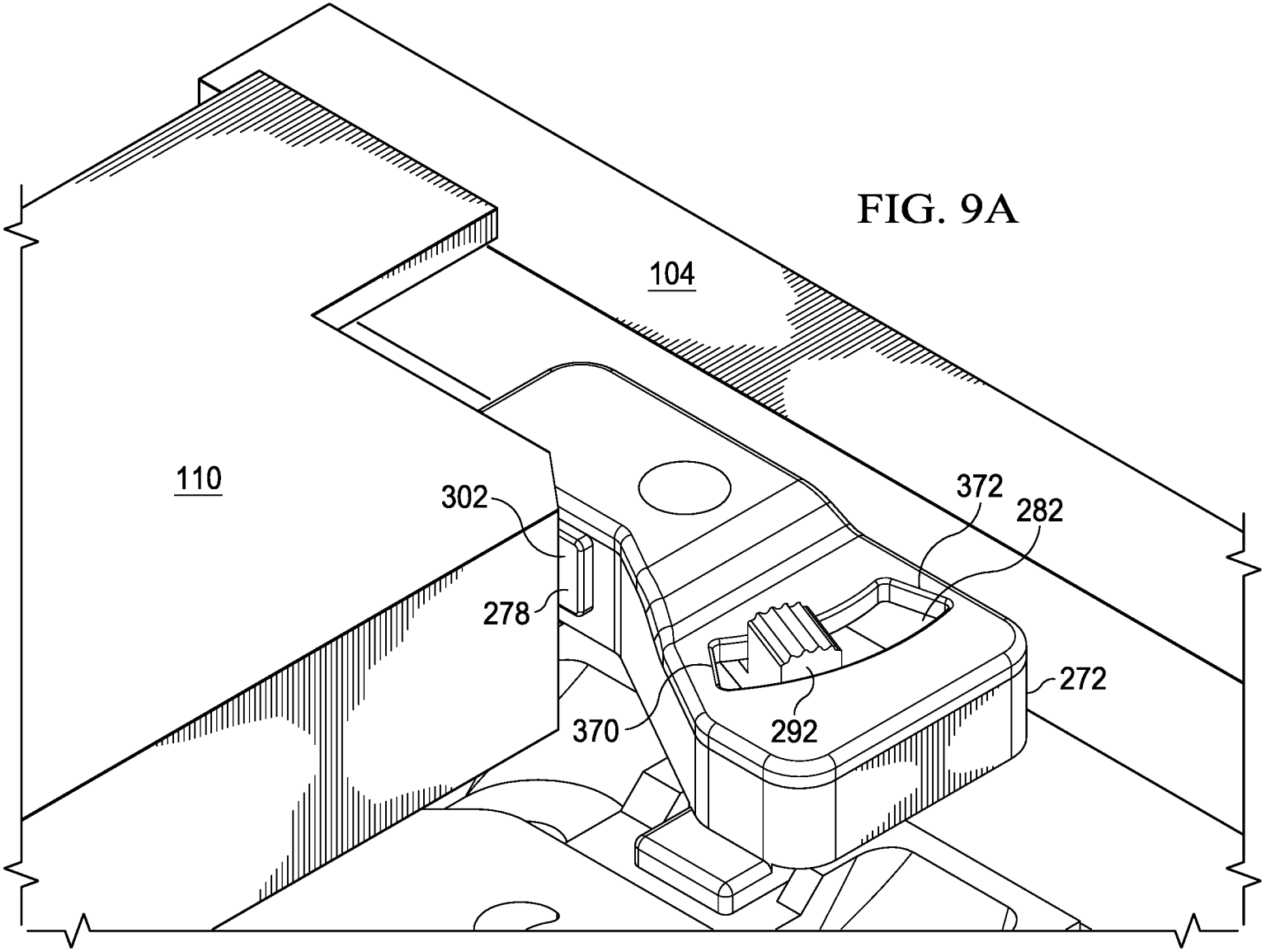
FIG. 9A is an isometric view of a preferred embodiment of the depth adjuster in position against a side rail.
Figure 9B:
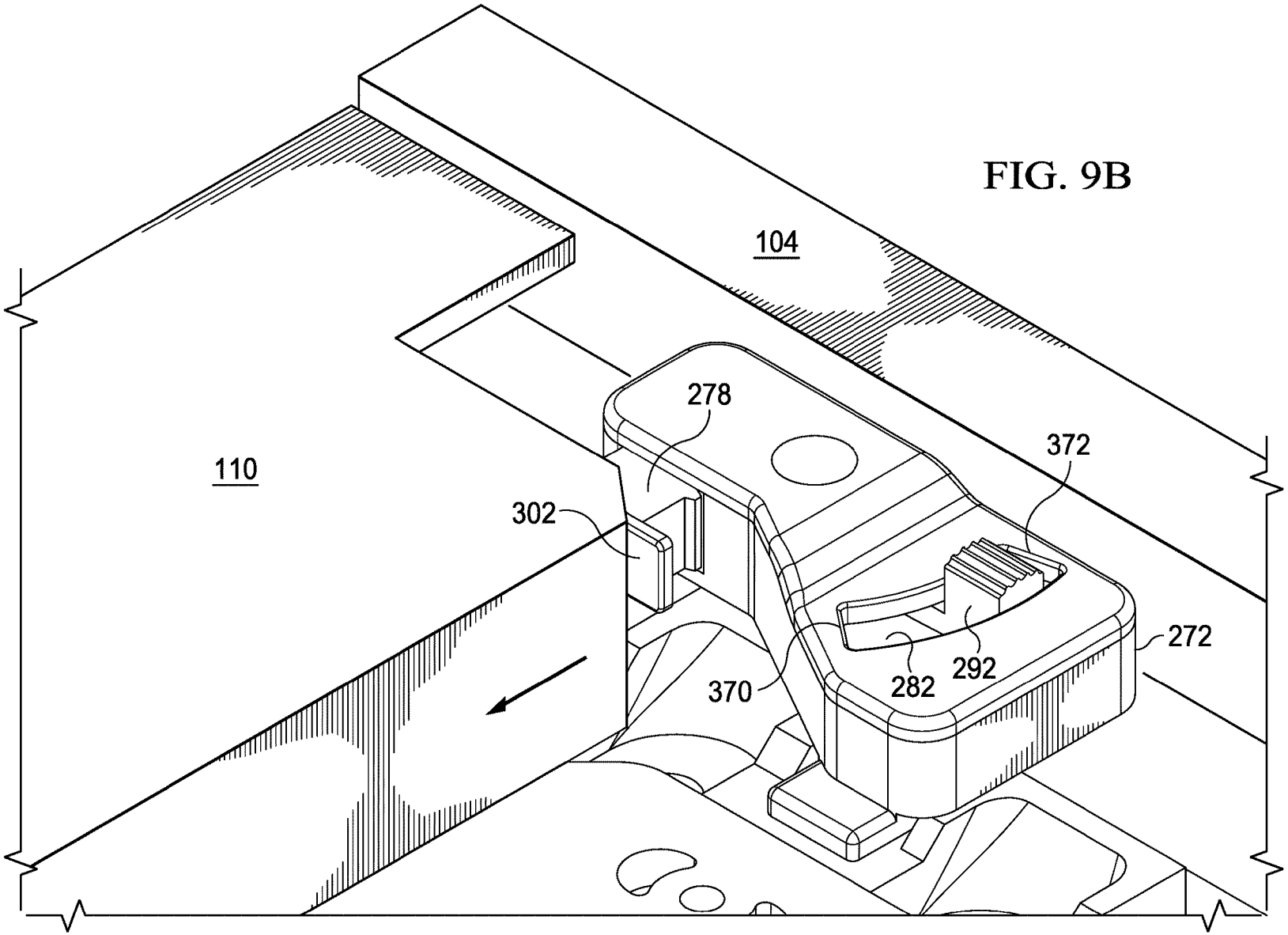
FIG. 9B is an isometric view of a preferred embodiment of the depth adjuster in position against a side rail.

Referring to FIG. 1, the underside of drawer 102 is shown. Drawer frame 107 is positioned adjacent drawer face 104. Undermount drawer slide clip mounting apparatus 100 is mounted on the underside of drawer 102. The drawer slide assembly is comprised of three slidingly engaged rails as is common in the art. Drawer rail 106 is removably engaged with undermount drawer slide clip mounting apparatus 100 and slidingly engaged with intermediate rail 108. Intermediate rail 108 is slidingly engaged with cabinet rail 110 (FIGS. 9A and 9B). Cabinet rail 110 is mounted to the cabinet carcass with conventional mounting hardware such as wood screws. Drawer rail 106 includes tab 114 and is further fitted with shoe 112. Tab 114 defines slot 115. Both shoe 112 and tab 114 are positioned on the front end of drawer rail 106. Undermount drawer slide clip mounting apparatus 100 allows adjustment in horizontal direction 150, vertical direction 152, and depth direction 154.

Alternate versions of the undermount drawer slide clip are provided for use on each of the right side of the drawer and the left side of the drawer. Only the left hand version will be described. But it should be understood that the left hand and right hand versions include similar but mirror image components.

Figure 2:
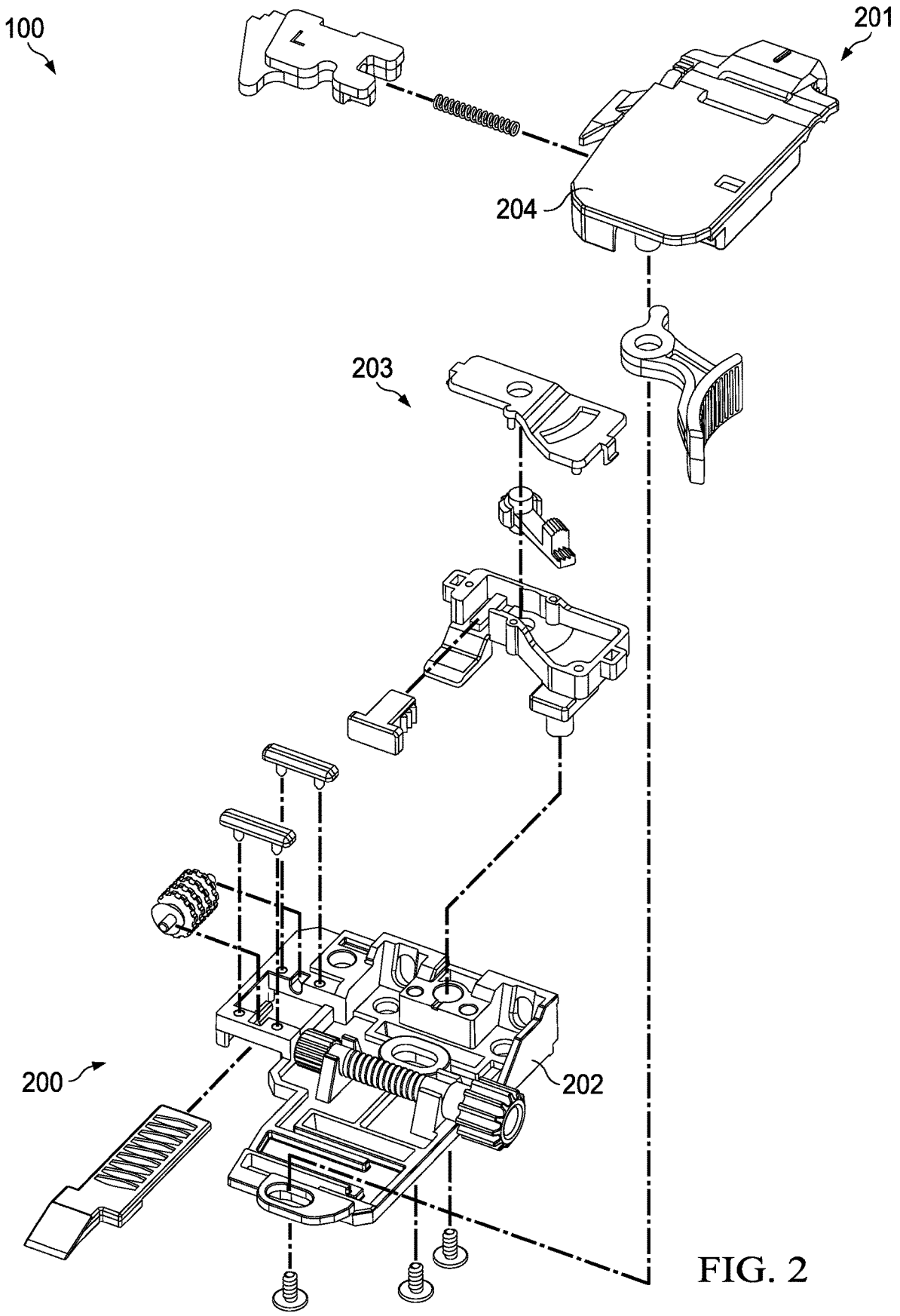
FIG. 2 is an exploded isometric view of a preferred embodiment.

Referring to FIG. 2, undermount drawer slide clip mounting apparatus 100 includes base subassembly 200, bonnet subassembly 201, and depth adjustment subassembly 203. Bonnet subassembly 201 is slidingly engaged with the base subassembly. The base subassembly also supports the depth adjustment subassembly.

Figure 3:
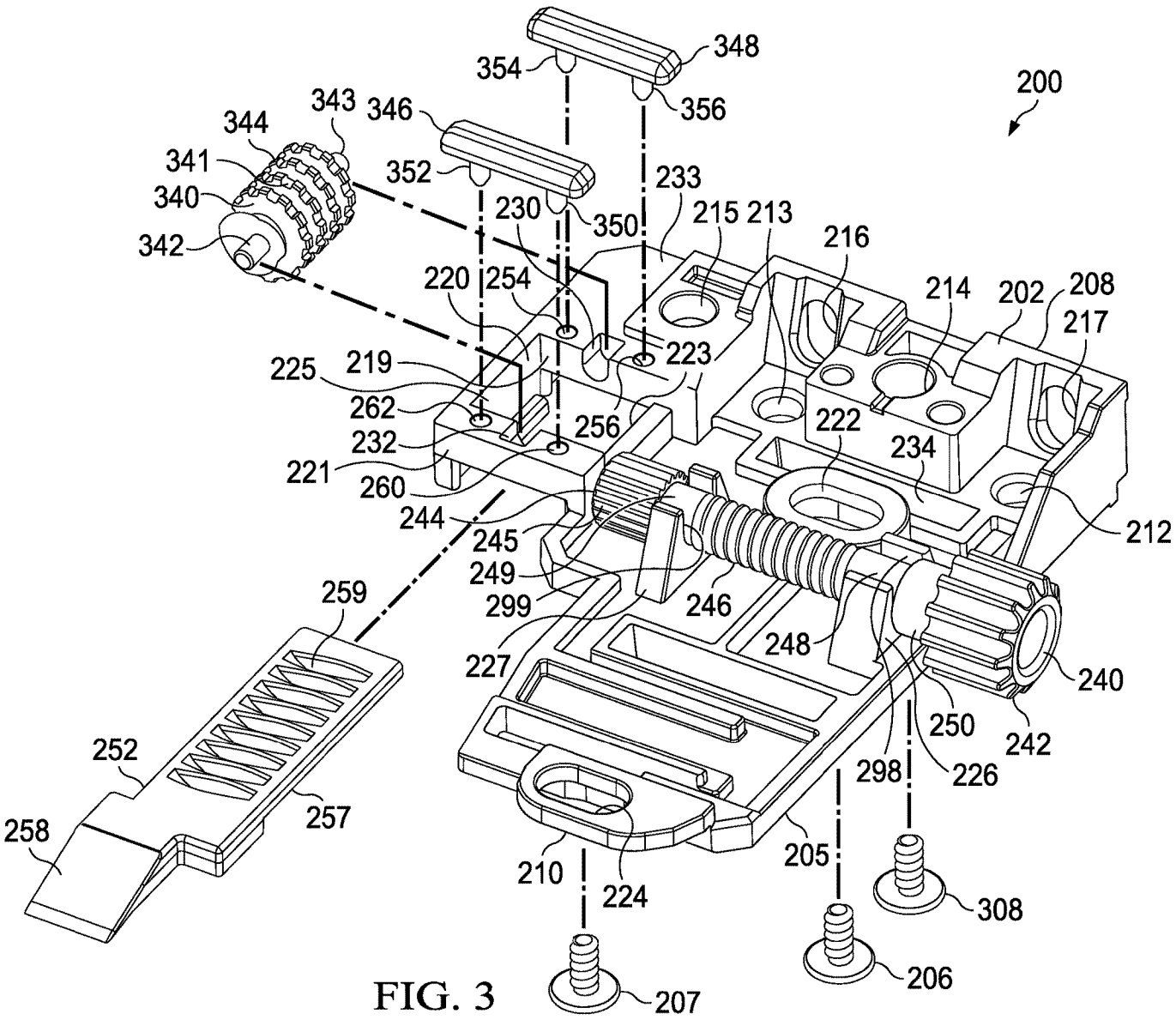
FIG. 3 is an exploded isometric view of a base subassembly of a preferred embodiment.
Figure 4:
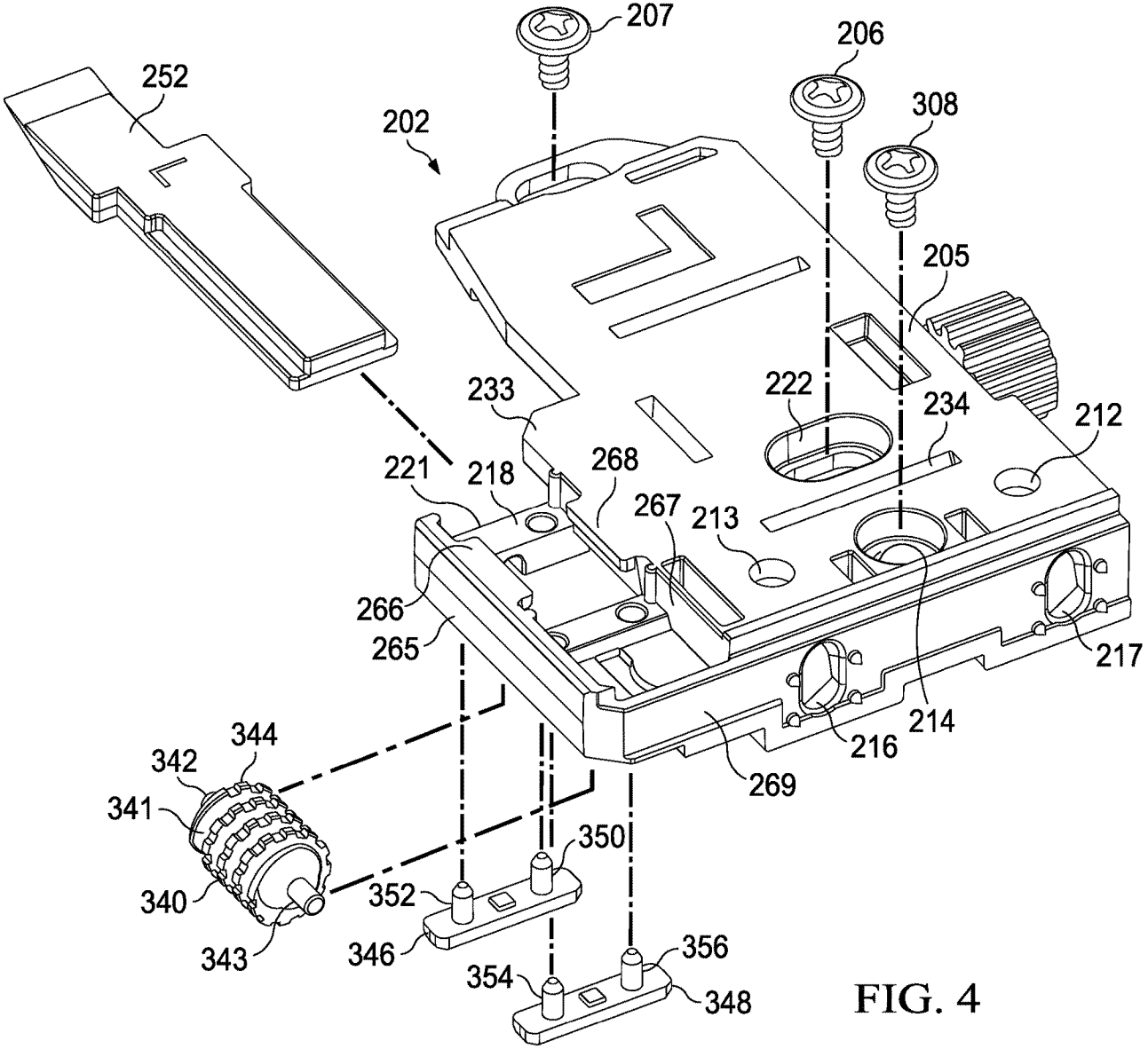
FIG. 4 is an exploded isometric view of a base subassembly of a preferred embodiment.

Referring to FIGS. 3 and 4, top and bottom views of the base subassembly will be described. Base subassembly 200 includes base 202, spindle 240, height adjuster 252, helical knob 340 and retaining caps 348 and 346. Base 202 has floor 205. Floor 205 includes mounting holes 212 and 213. Mounting face 208 extends substantially perpendicularly from floor 205 and includes mounting holes 216 and 217. Hole 214 is located between mounting holes 212 and 213, for positioning of the depth adjuster subassembly, as will be further described.

Slot 234 is formed in floor 205 adjacent mounting holes 212 and 213, and hole 214 and is substantially parallel to mounting face 208. Oblong hole 222 is formed in floor 205 adjacent slot 234. The oblong hole has an elongated axis that is generally parallel to the mounting face. Saddles 226 and 227 project substantially perpendicularly from floor 205 proximate oblong hole 222. The saddles include concave bearing surfaces 298 and 299, respectively. The bearing surfaces are aligned along a colinear axis that is substantially parallel with mounting face 208.

Flange 210 is integrally formed in base 202 adjacent floor 205. Oblong hole 224 is formed in flange 210 and is latitudinally aligned with oblong hole 222. Oblong holes 222 and 224 are used to guide movement of the bonnet subassembly when the clip is assembled, as will be further described.

Spindle 240 is rotatively positioned in the concave bearing surfaces. Spindle 240 includes knob 242 and ratchet 244. Spindle 240 includes threaded section 246 and cylindrical bearings 248 and 249. Cylindrical bearings 248 and 249 are seated in concave bearing surfaces 298 and 299, respectively. Collar 250 is located on the spindle between knob 242 and cylindrical bearing 248 and serves to axially position the spindle in the concave bearing surfaces. Ratchet 244 is located on the spindle adjacent cylindrical bearing 249. Ratchet 244 includes ratchet teeth 245 extending radially outward from the spindle.

Base 202 further includes extension 233 integrally formed with floor 205. Extension 233 includes hole 215 used for anchoring depth adjustment subassembly 203, as will be further described. Referring to FIG. 4, extension 233 includes longitudinal recess 218. Longitudinal recess 218 is bounded by walls 265, 267, and 269. Tab 266 extends substantially perpendicularly from wall 265. Tab 268 extends substantially perpendicularly from wall 267. Both tabs are substantially parallel with the floor.

Referring to FIG. 3, rectangular hole 220 extends upwardly through extension 233 and is ductedly connected to longitudinal recess 218. Rectangular hole 220 is bounded by vertical walls 219, 221, 223, and 225. Wall 219 includes integrally formed bearing cradle 230. Wall 221 includes integrally formed bearing cradle 232. Bearing cradles 230 and 232 share a single longitudinal axis and so are colinear. Holes 254 and 256 are located on either side of bearing cradle 230. Holes 260 and 262 are located on either side of bearing cradle 232.

Helical knob 340 is a generally cylindrical body that includes spiral slot 341 around its perimeter. Longitudinal teeth 344 are formed in the exterior surface of the cylindrical body. The longitudinal teeth are generally perpendicular to the spiral slot. Helical knob 340 includes coaxial spindles 342 and 343.

Retaining cap 346 includes pegs 350 and 352. Peg 350 is positioned in hole 260. Peg 352 is positioned within hole 262. Retaining cap 348 includes pegs 354 and 356. Peg 354 is positioned in hole 254. Peg 356 is positioned in hole 256. Pegs 350, 352, 354, and 356 are retained in respective holes 260, 262, 254, and 256 by an interference fit or by a suitable adhesive. Coaxial spindle 342 is positioned in bearing cradle 232. Coaxial spindle 343 is positioned in bearing cradle 230. Coaxial spindle 342 is retained in bearing cradle 232 by retaining cap 346. Coaxial spindle 343 is retained in bearing cradle 230 by retaining cap 348. As a result, helical knob 340 is rotatably fixed within rectangular hole 220.

Height adjuster 252 is slidably positioned in longitudinal recess 218 by tabs 266 and 268. Height adjuster 252 is comprised of ramp 258 integrally formed with receiver 257. Receiver 257 includes partial threads 259. In a preferred embodiment, partial threads 259 include a friction enhancing surface texture. The surface texture may be integrally formed in the threads or may take the form of a rubberized or epoxy textured coating. Spiral slot 341 of helical knob 340 is positioned within and engages partial threads 259. In a preferred embodiment, the teeth are seated movably yet firmly in the surface texture of the partial threads by the retaining caps. The firm seating prevents undesired rotation of the helical knob in the partial threads, thereby preventing unwanted movement of the height adjuster.

Figure 5:
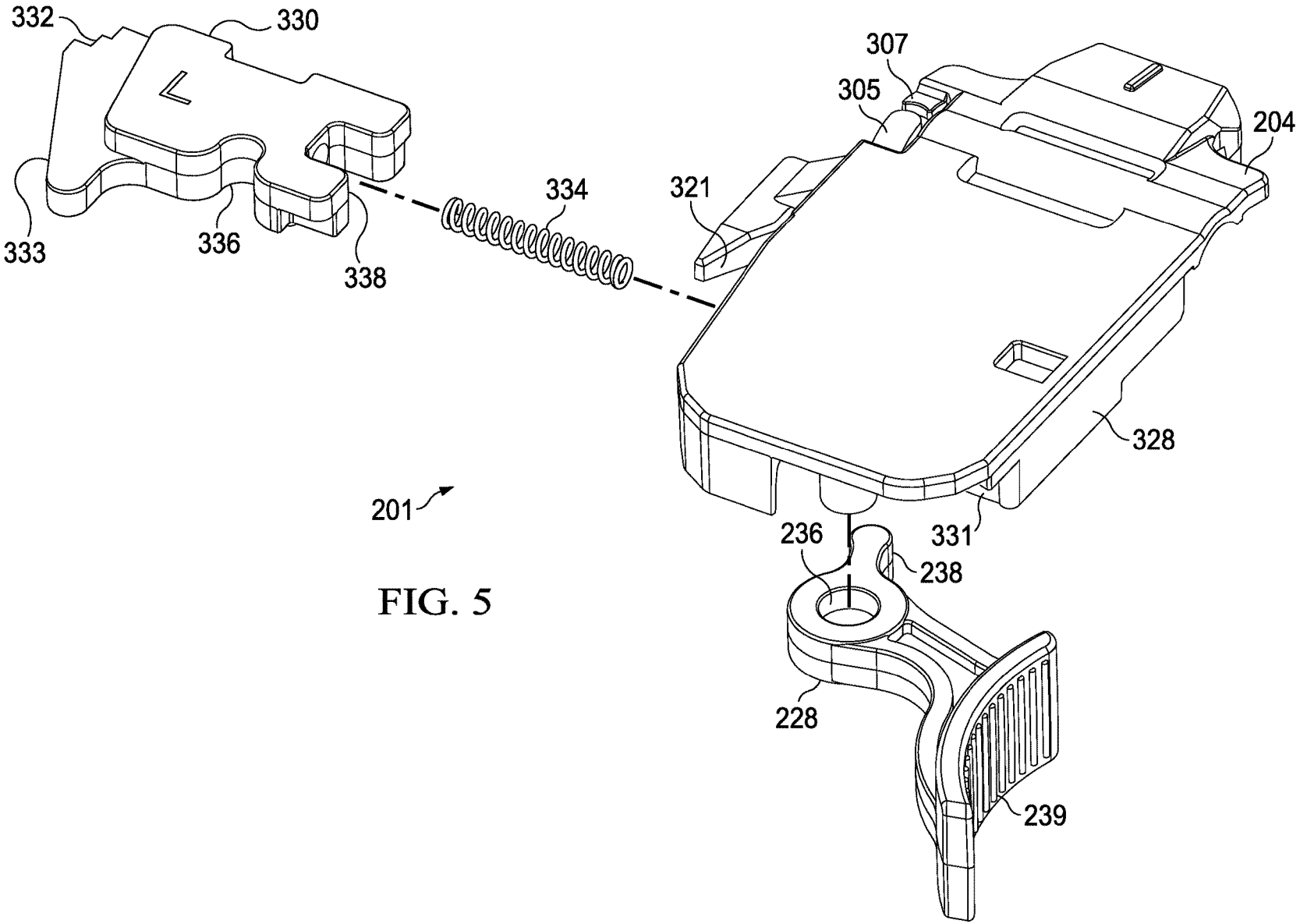
FIG. 5 is an exploded isometric view of a bonnet subassembly of a preferred embodiment.
Figure 6:
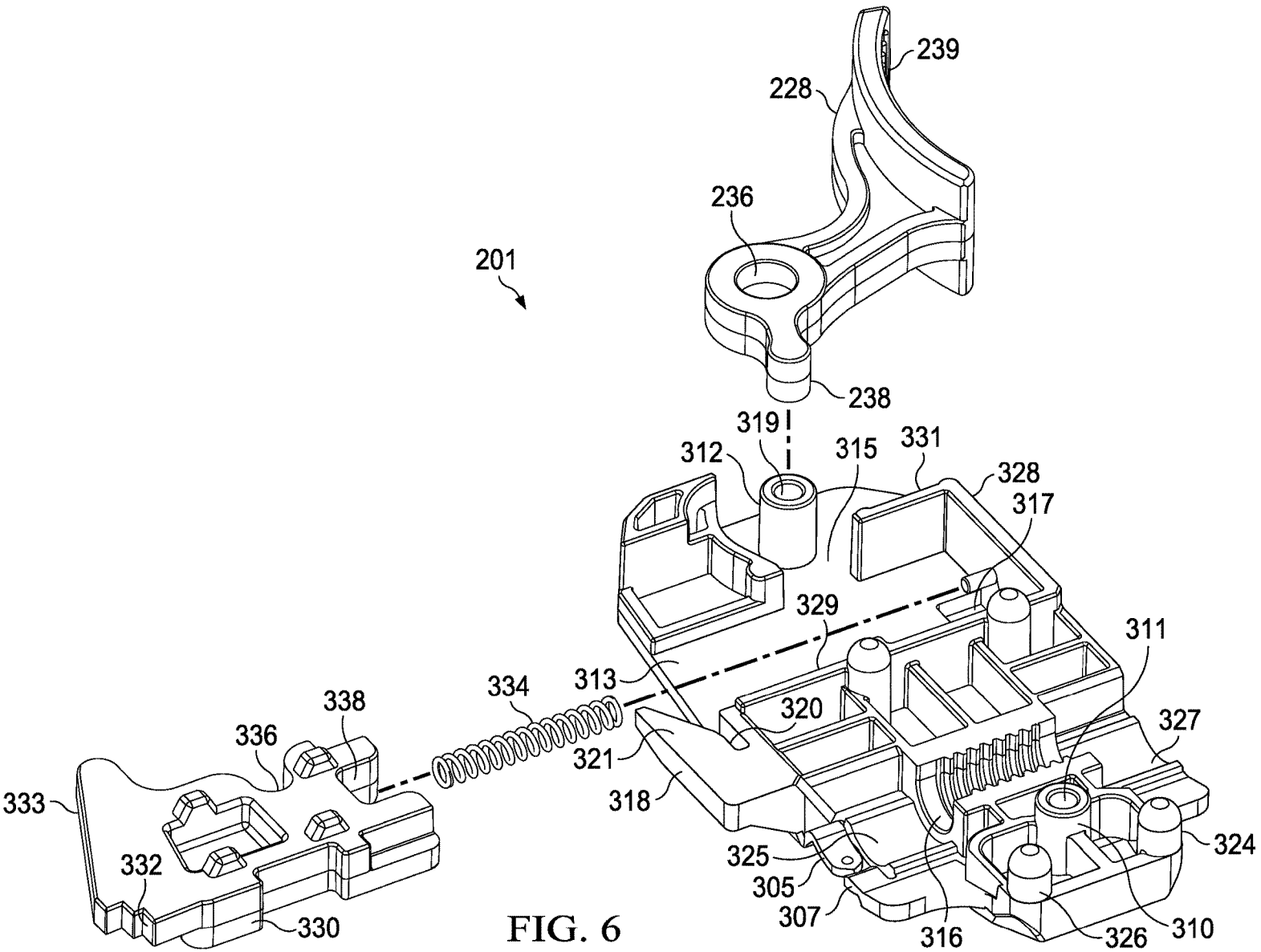
FIG. 6 is an exploded isometric view of a bonnet subassembly of a preferred embodiment.

Referring to FIGS. 5 and 6, top and bottom views of the bonnet subassembly will be described. Bonnet subassembly 201 comprises bonnet, catch 330, spring 334 and lever arm 228.

Stanchions 310 and 312 are integrally formed in the bonnet and extend downwardly from the bonnet into oblong holes 224 and 222 of the base. Stanchion 310 includes hole 311. Stanchion 312 includes hole 319. Holes 311 and 319 are used to secure the base to the bonnet, as will be further described.

Latitudinal channel 313 is formed by walls 328, 329, and 331. Wall 331 includes gap 315. Gap 315 accommodates strike 238, as will be further described. Wall 328 includes latitudinal spring retainer pin 317 which extends substantially perpendicular from wall 328.

Threaded cradle 316 extends downwardly from bonnet 204. In a preferred embodiment, the threaded cradle includes a friction enhancing surface texture. The surface texture may be integrally formed in the threads or take the form of an epoxy or rubberized coating. Bearing surfaces 325 and 327 are positioned adjacent the threaded cradle and support the spindle, as will be further described. Stanchions 324 and 326 extend downwardly from bonnet 204. When the clip is assembled, stanchions 324 and 326 fit within and are constrained by slot 234 of the base subassembly. Threaded section 246 of spindle 240 engages threaded cradle 316. The surface texture eliminates unwanted rotation of the spindle.

Bonnet 204 includes integrally formed pawl arms 305 and 307. The pawl arms are both flexible and resilient. The pawl arms are positioned to engage the radial teeth of the spindle. When the clip is assembled, the resilient nature of the pawl arms allows intended rotation of the spindle to affect adjustment of the clip, but resists unintended rotation of the spindle when the drawer is in use.

Bonnet 204 further includes integrally formed latch arm 318. Latch arm 318 extends latitudinally from bonnet 204. Latch arm 318 includes slot 320 and locator surface 321.

Bonnet 204 rotatably supports lever arm 228. Lever arm 228 is generally elbow shaped and includes strike 238 and trigger 239. The lever arm further includes centrally positioned pivot hole 236. Pivot hole 236 is rotatably positioned on stanchion 312. Stanchion 312 fits withing oblong hole 224 when the clip is assembled and serves to guide movement of the bonnet relative to the base. Strike 238 is sized to fit within gap 315 and extend into latitudinal channel 313.

Bonnet subassembly 201 further includes catch 330. Catch 330 is slidably positioned in latitudinal channel 313. Catch 330 includes notch 332 adjacent angled edge 333. Catch 330 further includes spring seat 338. Disposed between angled edge 333 and spring seat 338 is slot 336. Slot 336 is sized to accommodate strike 238 of lever arm 228.

Spring 334 is positioned between spring seat 338 and latitudinal spring retainer pin 317. Spring 334 biases wall 328 against catch 330 and positions the catch so that notch 332 is adjacent locator surface 321.

Bonnet subassembly 201 is attached to base subassembly 200 by stanchion 310 and stanchion 312. Screw 206 extends from the bottom of base 202, through oblong hole 222 and into hole 311. Screw 207 extends from the bottom of base 202, through oblong hole 224 and into hole 319. The oblong holes permit the bonnet subassembly to slide latitudinally with respect to the base subassembly.

Figure 7:
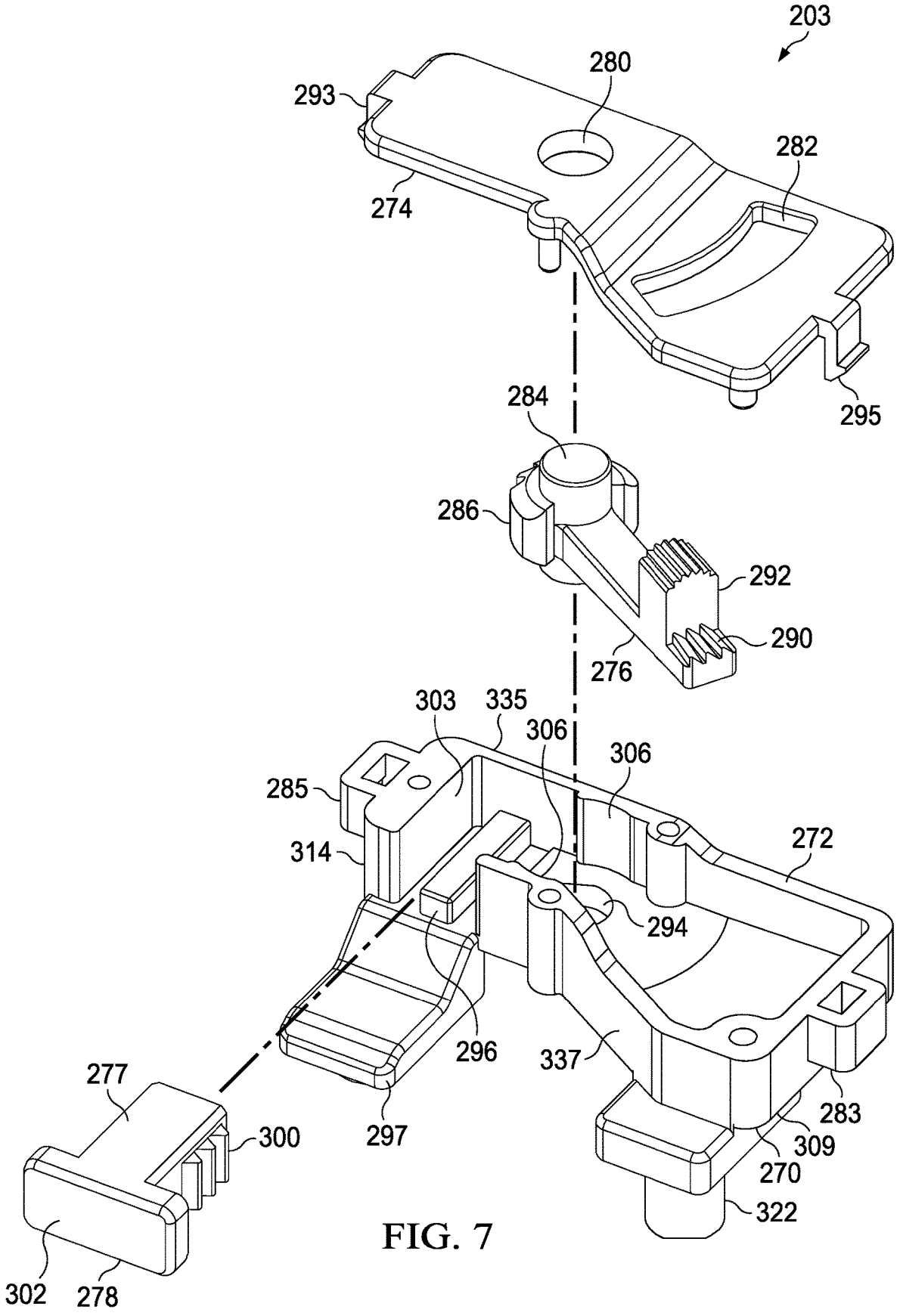
FIG. 7 is an exploded isometric view of a depth adjustment subassembly of a preferred embodiment.
Figure 8:
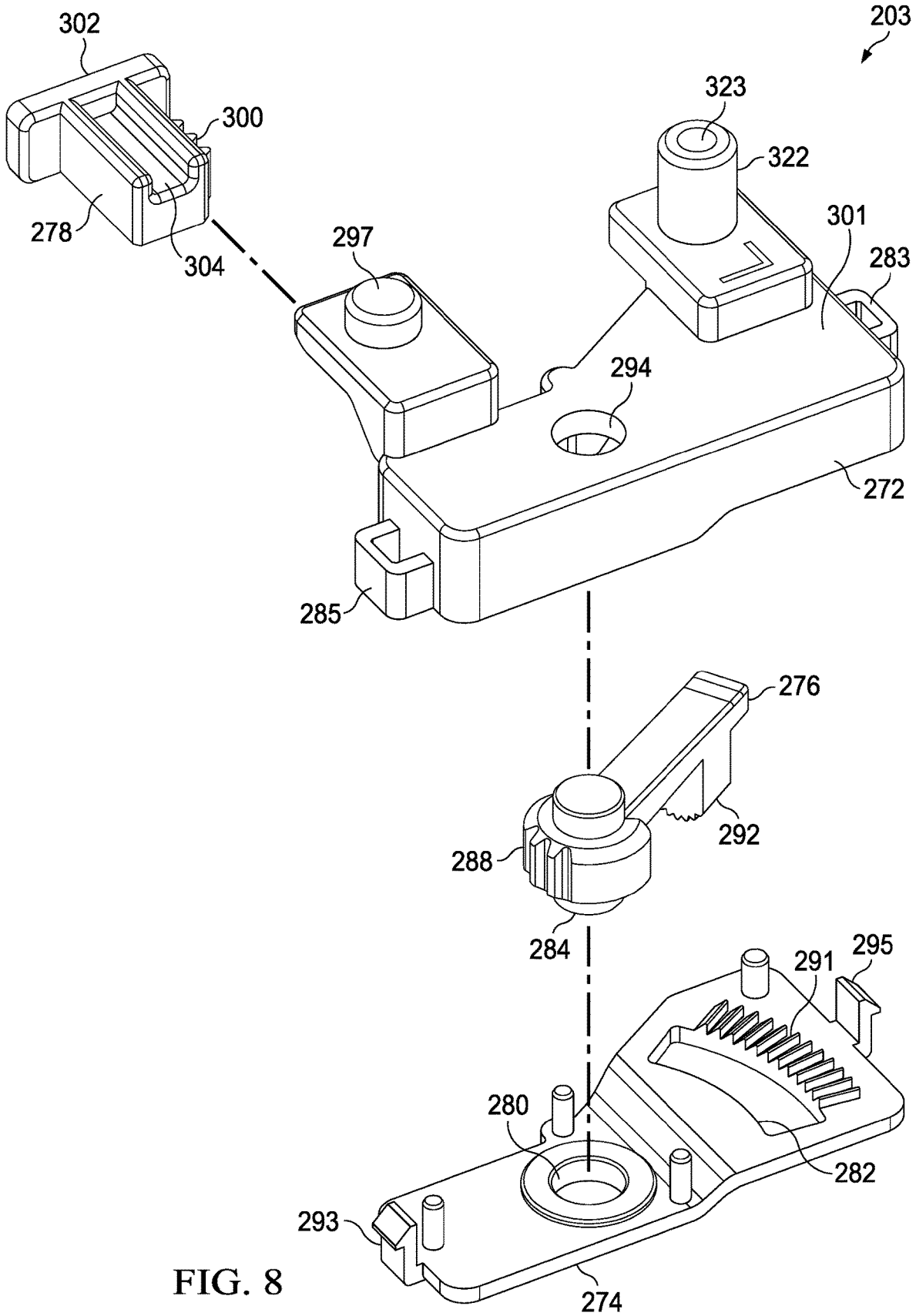
FIG. 8 is an exploded isometric view of a depth adjustment subassembly of a preferred embodiment.

Referring to FIGS. 7 and 8, top and bottom views of the depth adjuster subassembly will be described. Depth adjuster subassembly 203 comprises adjuster body 270, cover 274, lever 276 and plunger 278.

Adjuster body 270 is generally triangular and is formed from side walls 335 and 337, end walls 309 and 314, and floor 301. Side wall 337 includes longitudinal channel 303. Guide track 296 is positioned on the floor within and is generally parallel to longitudinal channel 303. Floor 301 includes pivot hole 294. Stanchions 297 and 322 extend downwardly from floor 301. Stanchion 322 includes hole 323 sized to receive screw 308. Cylindrical guide surface 306 is integrally formed with side walls 335 and 337 and is concentrically positioned adjacent pivot hole 294.

Cover 274 is a generally triangular plate releasably fitted to adjuster body 270. Cover 274 includes pivot hole 280 and arcuate slot 282. Cover 274 includes radial teeth 291 extending downwardly adjacent arcuate slot 282. Both the arcuate slot and the radial teeth are coaxial with pivot hole 280.

Flange 283 is integrally formed on end wall 309. Flange 285 is integrally formed on end wall 314. Hooks 293 and 295 are integrally formed in cover 274. When the depth adjuster subassembly is assembled, hooks 293 and 295 are positioned in flanges 283 and 285 to secure cover 274 to adjuster body 270.

Lever 276 includes axle 284 coaxial with cylindrical collar 286. Lever 276 further includes teeth 290 and knob 292. When the depth adjuster subassembly is assembled, teeth 290 engage teeth 291. Knob 292 extends upward from lever 276 through arcuate slot 282. Lever 276 is pivotally engaged with housing 272 and cover 274 by axle 284 positioned in pivot holes 294 and 280. Surrounding axle 284 is cylindrical collar 286. Cylindrical collar 286 is constrained to rotate within cylindrical guide surface 306. Cylindrical collar 286 further includes teeth 288.

Plunger 278 includes rectangular body 277, integrally formed with face 302 and side teeth 300. Plunger 278 is slidingly positioned in longitudinal channel 303. Plunger 278 includes slot 304 which is constrained by the channel to move on guide track 296. Side teeth 300 engage teeth 288.

Adjuster body 270 is attached to base 202 by screw 308. Screw 308 extends from the bottom of base 202 through hole 214 and into hole 323 in stanchion 322. Stanchion 297 is fitted to hole 215.

In a preferred embodiment, components of undermount drawer slide clip mounting apparatus 100 are manufactured from polystyrene, PVC (polyvinyl chloride), or nylon. In an alternate embodiment, the base may be cast from a sturdy zinc alloy.

In use, undermount drawer slide clip mounting apparatus 100 is affixed to the underside of drawer 102 with screws through mounting holes 212 and 213 or affixed to drawer frame 107 with screws through mounting holes 216 and 217. To releasably attach the clip to drawer rail 106, lever arm 228 is pivoted in pivot hole 236 by applying a force to trigger 239 in a direction generally parallel to the bottom surface of the drawer towards the drawer slide assembly. Trigger 239 is sized and shaped to be manipulated by hand without tools. Strike 238 projects through gap 315, abuts catch 330 within slot 336, and moves catch 330 within latitudinal channel 313 against the bias of spring 334. Tab 114 of drawer rail 106 is inserted into slot 320. Drawer rail 106 slides over ramp 258 on height adjuster 252. Trigger 239 is released allowing notch 332 to pass through slot 115 and under shoe 112. Angled edge 333 assists in the alignment of notch 332 with slot 115.

To adjust the vertical position of the drawer relative to the cabinet carcass, a force is applied to helical knob 340 causing helical knob 340 to rotate around coaxial spindles 342 and 343. Rotation of helical knob 340 causes spiral slot 341 to engage with partial threads 259. One direction of rotation of helical knob 340 results in receiver 257 retracting into longitudinal recess 218. The opposite direction of rotation of helical knob 340 results in receiver 257 extending from longitudinal recess 218 in a direction generally parallel with the opening and closing direction of the drawer. Extending height adjuster 252 towards drawer rail 106 causes the front end of drawer rail 106 to advance up ramp 258 to adjust the drawer upward relative to the cabinet carcass. Retracting height adjuster away from drawer rail 106 causes the front end of drawer rail 106 to move down ramp 258 and thus the drawer in a downward direction relative to the cabinet carcass. Rotation of helical knob 340 allows for very small and incremental changes in the vertical position of the drawer. Longitudinal teeth 344 on the surface of helical knob 340 engage the friction surface of partial threads 259 and prevent unintended movement of ramp 258 so that adjustment of the drawer is maintained.

To adjust the horizontal position of the drawer relative to the cabinet carcass, a rotational force is applied to spindle 240 via knob 242. Threaded section 246 engages threaded cradle 316. As spindle 240 rotates, bonnet 204 moves horizontally with respect to base 202. Movement of bonnet 204 results in corresponding horizontal movement of drawer rail 106 in relation to drawer 102. As the spindle is rotated by the knob, the pawls flexibly engage the radial teeth and allow metered rotation of the spindle. When the knob is released, the pawls prevent movement of the radial teeth and thereby lock the spindle in position to avoid undesired horizontal adjustment while the drawer is in use.

As shown in FIGS. 9A and 9B, when the drawer is in a closed position, cabinet rail 110 abuts face 302 on plunger 278. The position of plunger 278 determines the depth of the drawer relative to the cabinet carcass. To adjust the depth, the drawer closes relative to the cabinet carcass, plunger 278 is extended from or retracted within housing 272. As plunger 278 extends from housing 272, the closed position of the drawer relative to the cabinet carcass is extended from the cabinet carcass. To extend plunger 278 out of housing 272, a force is applied to knob 292 to release teeth 290 from engagement with teeth 291. Once the teeth are disengaged, lever 276 is pivoted in pivot hole 280 via axle 284. Rotation of cylindrical collar 286 is confined by cylindrical guide surface 306. Teeth 288 engage side teeth 300 and convert the rotational movement of lever 276 into linear movement of plunger 278. Movement of knob 292 from point 370 to point 372 extends plunger 278 from housing 272 thereby extending the drawer with respect to the cabinet carcass. Movement of knob 292 from point 372 to point 370 retracts plunger 278 into housing 272 thereby retracting the drawer relative to the cabinet carcass. Once the desired depth is achieved, the force on knob 292 is removed and teeth 290 reengage with teeth 291. Knob 292 may also be positioned anywhere between points 370 and 372 along arcuate slot 282 to affect a depth adjustment.

Figure 10A:
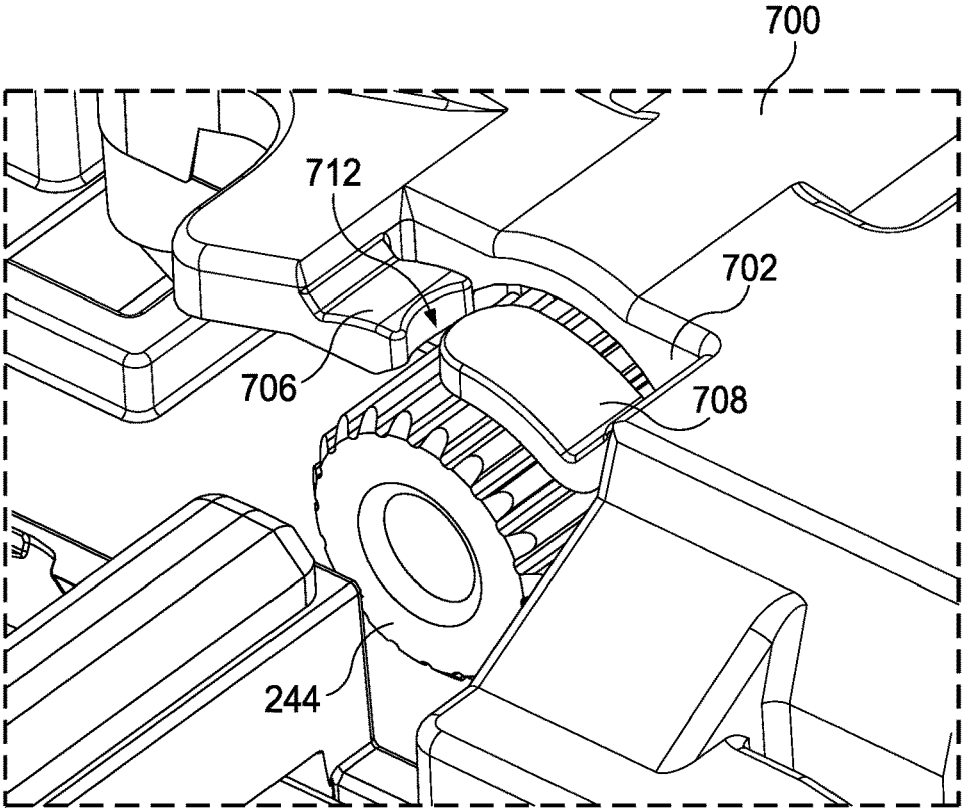
FIG. 10A is a partial isometric view of a preferred embodiment of a ratchet and pawl.
Figure 10B:
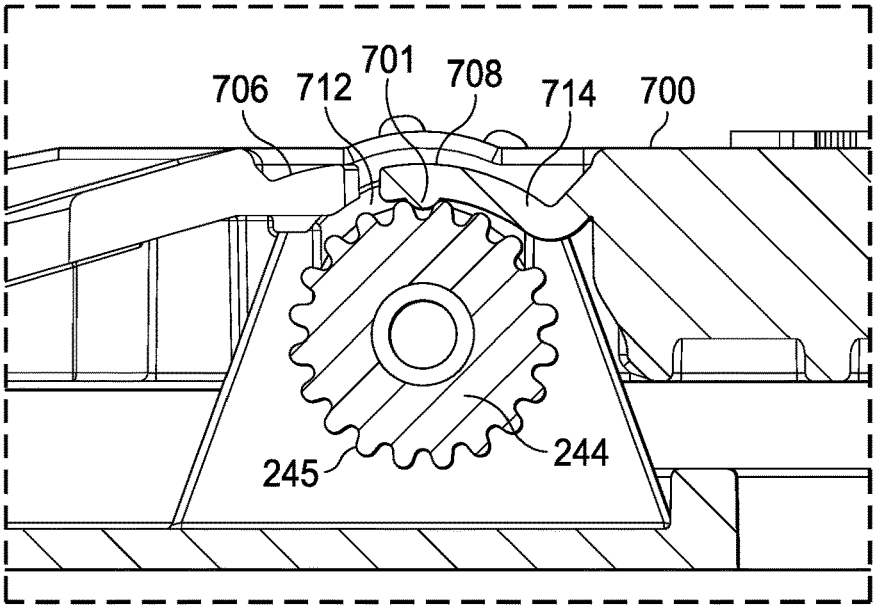
FIG. 10B is a cutaway side view of a preferred embodiment of a ratchet and pawl.

Referring to FIGS. 10A and 10B, an alternate embodiment of bonnet 700 is shown. Bonnet 700 comprises recess 702 positioned to contain ratchet 244. Ratchet 244 is positioned adjacent pawl arm 708. Pawl arm 708 is further comprised of resilient arm 714 supporting downward facing engagement tooth 701. Pawl arm 708 engages ratchet teeth 245 of ratchet 244. In a preferred embodiment, the resilient arm is integrally formed with the bonnet. Engagement tooth 701 extends downward from resilient arm 714 at an angle of attack tangent to ratchet 244. Cover tab 706 is provided adjacent the resilient arm and is also integrally formed with the bonnet. The cover tab is provided to shield the ratchet from unintended interference from debris when the drawer is in use. Gap 712 is provided between the tab and the pawl arm so as to allow movement of the pawl arm when adjustments are made.

In use, resilient arm 714 provides a downward bias to engagement tooth 701 and ratchet 244. The bias from resilient arm 714 further forces spindle 240 into the concave bearing surfaces of the base thereby stabilizing the spindle in the assembly. When ratchet 244 is rotated (either clockwise or counterclockwise) to adjust the horizontal position of the drawer, engagement tooth 701 is forced out of engagement with the ratchet teeth, this allowing rotation of the spindle. After adjustment, the downward bias of the resilient arm maintains engagement of the ratchet teeth with the engagement tooth and reduces or eliminates rotation of the ratchet to maintain the adjustment.

Figure 11A:
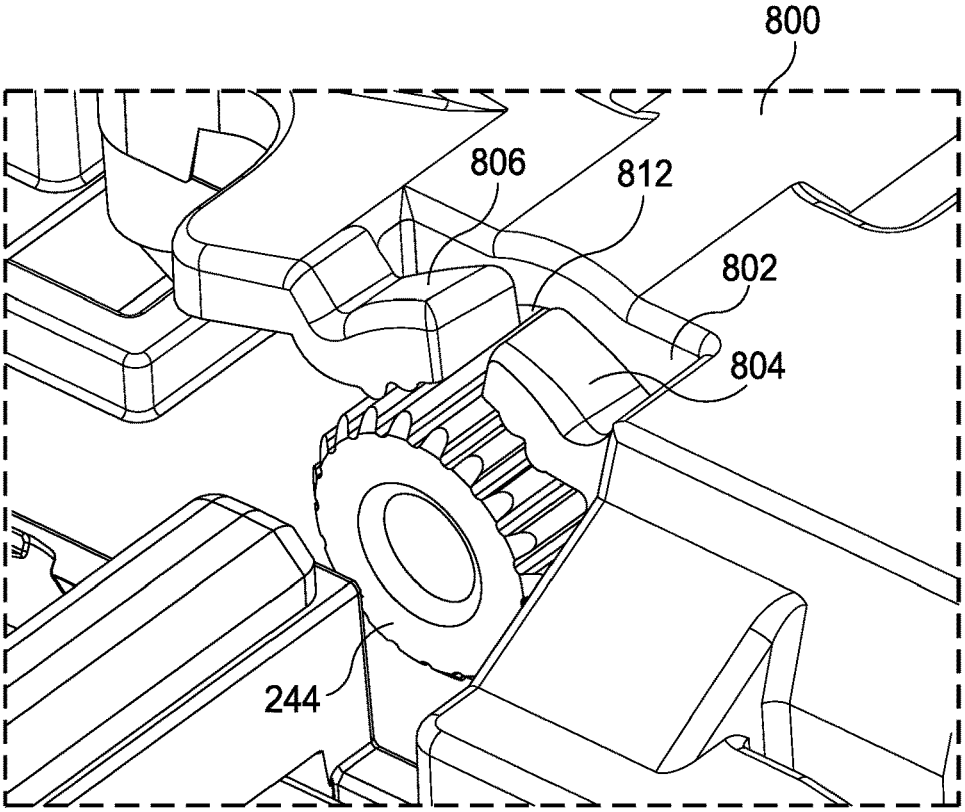
FIG. 11A is a partial isometric view of an alternate embodiment of a ratchet and pawl.
Figure 11B:
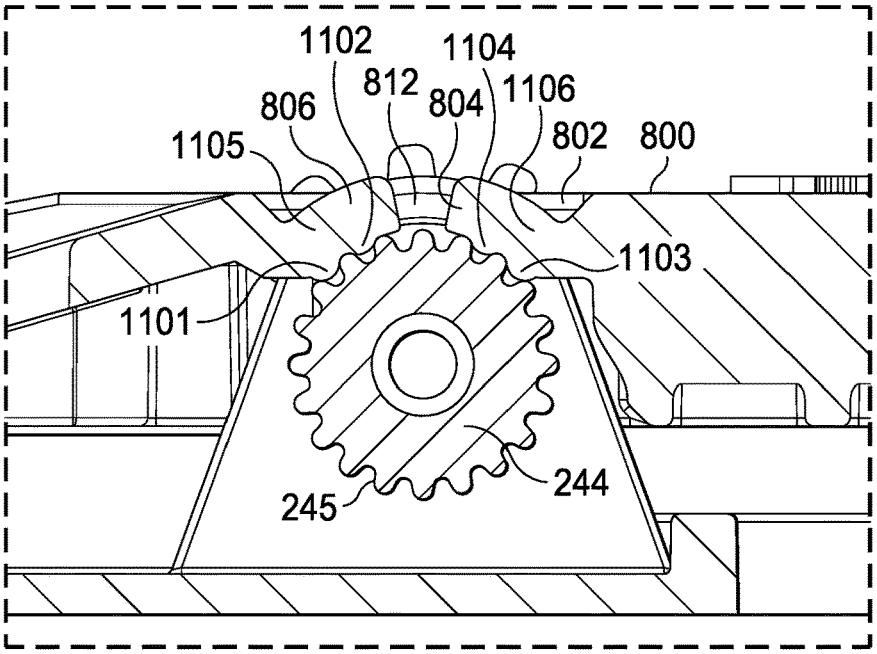
FIG. 11B is a cutaway side view of an alternate embodiment of a ratchet and pawl.

Referring to FIGS. 11A and 11B, an alternative embodiment of bonnet 800 is shown. Bonnet 800 comprises recess 802 positioned adjacent ratchet 244. Pawl arms 804 and 806 oppositely extend from bonnet 800 and are separated by gap 812. The gap allows the two pawl arms to move independently from one another.

Pawl arm 806 includes resilient support 1105 and engagement teeth 1101 and 1102. The resilient support is generally arcuate and ideally is integrally formed with the bonnet. Engagement tooth 1101 extends downward from resilient support 1105 engaging ratchet teeth 245. Engagement tooth 1102 is positioned adjacent engagement tooth 1101 and extends downward from resilient support 1105 engaging ratchet teeth 245.

Pawl arm 804 includes resilient support 1106 and engagement teeth 1103 and 1104. Engagement tooth 1103 extends downward from resilient support 1106 engaging ratchet teeth 245. Engagement tooth 1104 is positioned adjacent engagement tooth 1103 and extends downward from resilient support 1106 engaging ratchet teeth 245.

Figure 11C:
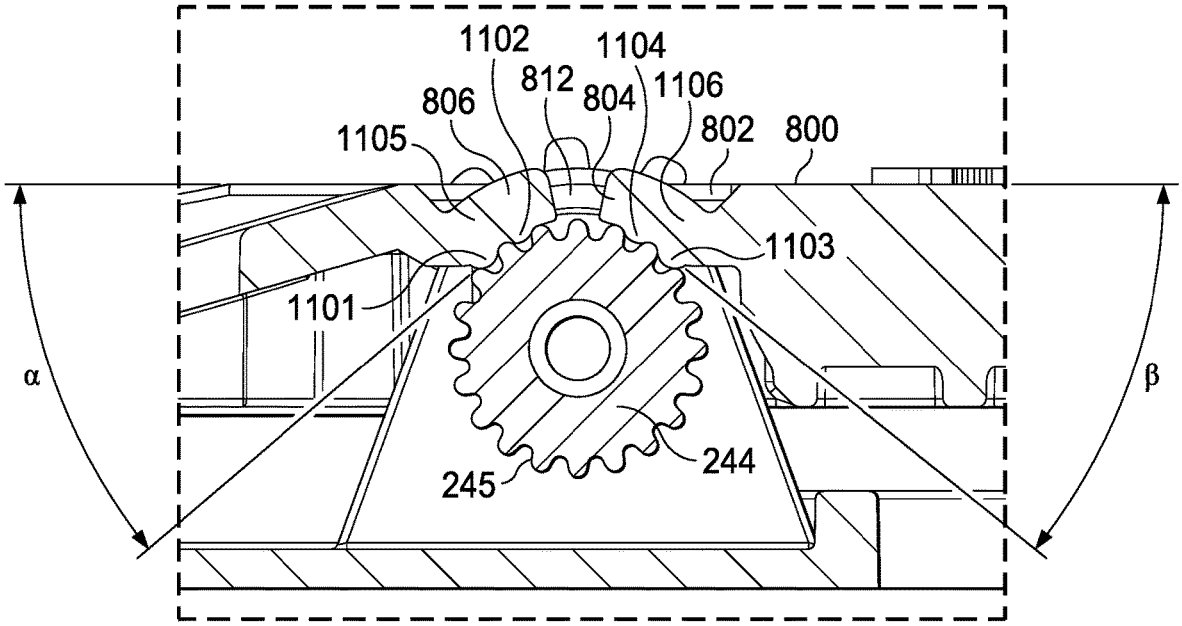
FIG. 11C is a cutaway side view of an alternate embodiment of a ratchet and pawl.

Referring to FIG. 11C, engagement teeth 1101 and 1102 are positioned on resilient support 1105 so as to constitute a tangential angle of attack of about +30° to the horizontal indicated by "$\alpha$". Engagement teeth 1103 and 1104 are positioned on resilient support 1106 so as to constitute a tangential angle of attack of about −30° to the horizontal indicated by "$\beta$". In other preferred embodiments, angle $\alpha$ can range from about +10° to about +45°. Similarly, angle $\beta$ may range from about −10° to about −45°. The differing angles of attack provided by the pawl arms is important because, due to the positions of the pawl arms, pawl arm 806 provides an increased resistance to counterclockwise rotation of the spindle, while pawl arm 804 provides an increased resistance to clockwise rotation of the spindle. Operating in tandem, the pawl arms provide an increased resistance to undesired rotation of the spindle, thereby maintaining the adjustment. Further in other embodiments, the ratchet teeth on each pawl arm may be different sizes.

In use, resilient support 1105 biases engagement teeth 1101 and 1102 downwardly causing engagement teeth 1101 and 1102 to engage ratchet teeth 245. Similarly, resilient support 1106 biases engagement teeth 1103 and 1104 downwardly causing engagement teeth 1103 and 1104 to engage ratchet teeth 245. The bias from resilient supports 1105 and 1106 results in a bias force acting on ratchet 244 thereby urging spindle 240 into the concave bearing surfaces of the base and stabilizing the assembly.

When ratchet 244 is rotated in one direction to adjust the horizontal position of the drawer, engagement teeth 1101, 1102, 1103, and 1104 are forced out of engagement with the ratchet teeth, until the desired horizontal position of the drawer is reached. When adjustment is complete, the downward bias of resilient supports 1105 and 1106 maintains the engagement teeth with the ratchet teeth.

In the alternative embodiments, cover tab 706 and pawl arm 708 would preferably be integrally formed with bonnet 700 and pawl arms 804 and 806 would preferably be integrally formed with bonnet 800.

It will be appreciated by those skilled in the art that changes could be made to the embodiments described above without departing from the broad inventive concept. It is understood, therefore, that this disclosure is not limited to the particular embodiments herein, but it is intended to cover modifications within the spirit and scope of the present disclosure as defined by the appended claims.

The invention claimed is:

1. A drawer slide clip mounting apparatus comprising:
a base;
a bonnet slidingly engaged with the base;
a trigger pivotally connected to the bonnet;
a ramp adjustably engaged with the base;
a threaded shaft, seated in the base and engaged with the bonnet;
a threaded cylinder, having a spiral groove, seated in the base by a pair of coaxial spindles, the spiral groove engaged with the ramp;
a plunger, adjustably mounted to the base;
wherein a horizontal adjustment occurs when the threaded shaft is rotated, a vertical adjustment occurs when the threaded cylinder is rotated, and a depth adjustment occurs when the plunger is moved;
a set of ratchet teeth on the threaded shaft;
a pawl means for frictionally engaging the set of ratchet teeth;
wherein the pawl means further comprises a set of pawl teeth; and,
wherein the set of pawl teeth further comprises one of a group of:
(a) a first pawl tooth and a second pawl tooth of differing sizes; and,
(b) the first pawl tooth and the second pawl tooth having differing angles of attack.

2. The drawer slide clip mounting apparatus of claim 1 wherein the threaded cylinder further comprises a first friction enhancing surface.

3. The drawer slide clip mounting apparatus of claim 2 wherein the ramp further comprises a second friction enhancing surface engaged with the first friction enhancing surface.

4. The drawer slide clip mounting apparatus of claim 3 wherein the first friction enhancing surface and the second friction enhancing surface are each one of a group of a textured coating and an integral surface texture.

5. The drawer slide clip mounting apparatus of claim 1 wherein the pawl means further comprising:
an arcuate pawl arm, integrally formed with the bonnet; and,
an arcuate cover arm, opposite the arcuate pawl arm.

6. The drawer slide clip mounting apparatus of claim 5 wherein the arcuate pawl arm further comprises:
a pawl tooth engaged with the set of ratchet teeth.

7. The drawer slide clip mounting apparatus of claim of claim 1 wherein the pawl means further functions to provide an indexing engagement with the set of ratchet teeth.

8. The drawer slide clip mounting apparatus of claim 1 wherein the pawl means further comprises a first pawl arm and a second pawl arm.

9. The drawer slide clip mounting apparatus of claim 8 wherein the first pawl arm and the second pawl arm are integrally formed with the bonnet.

10. The drawer slide clip mounting apparatus of claim 8 wherein the first pawl arm is operatively disposed opposite the second pawl arm.

11. The drawer slide clip mounting apparatus of claim 8 wherein the first pawl arm and the second pawl arm are positioned generally traverse to a central axis of the threaded shaft.

12. The drawer slide clip mounting apparatus of claim 1 further comprising:
a housing connected to the base;
a lever, pivotally connected to the housing; and,
a cap engaged with the lever.

13. The drawer slide clip mounting apparatus of claim 12 wherein the plunger extends from the housing at a first distance when the lever is in a first position and at a second distance when the lever is in a second position.

14. The drawer slide clip mounting apparatus of claim 12 wherein the lever is movable between an engaged position and a disengaged position.

15. The drawer slide clip mounting apparatus of claim 1 wherein the threaded shaft is rotationally supported by the base.

16. The drawer slide clip mounting apparatus of claim 15 wherein the threaded shaft further comprises a friction enhanced surface.

* * * * *